US011612221B2

(12) United States Patent
Hsu et al.

(10) Patent No.: US 11,612,221 B2
(45) Date of Patent: Mar. 28, 2023

(54) SLIDER AND SLIDER ASSEMBLING METHOD

(71) Applicant: YKK CORPORATION, Tokyo (JP)

(72) Inventors: Hsien Hsiang Hsu, Taipei (TW); Chun Chun Lai, Taipei (TW); Shinya Honda, Taipei (TW)

(73) Assignee: YKK CORPORATION

( * ) Notice: Subject to any disclaimer, the term of this patent is extended or adjusted under 35 U.S.C. 154(b) by 0 days.

(21) Appl. No.: 17/153,262

(22) Filed: Jan. 20, 2021

(65) Prior Publication Data

US 2021/0219672 A1 Jul. 22, 2021

(30) Foreign Application Priority Data

Jan. 22, 2020 (CN) ..... 202010073401.5

(51) Int. Cl.
*A44B 19/26* (2006.01)
*B21D 53/54* (2006.01)
*B21D 53/52* (2006.01)

(52) U.S. Cl.
CPC ..... *A44B 19/262* (2013.01); *B21D 53/52* (2013.01); *B21D 53/54* (2013.01)

(58) Field of Classification Search
CPC ..... A44B 19/262; A44B 19/26; A44B 19/42; B21D 53/52; B21D 53/54
See application file for complete search history.

(56) References Cited

U.S. PATENT DOCUMENTS 2,280,999 A * 4/1942 Carlile ..... A44B 19/305 24/429
2,723,446 A * 11/1955 Lawson ..... B21D 53/54 24/416
3,133,328 A * 5/1964 Huelster ..... A44B 19/306 24/421

(Continued)

FOREIGN PATENT DOCUMENTS

CN 102370295 3/2012
CN 102726896 10/2012

(Continued)

OTHER PUBLICATIONS

YKK Corporation; Office Action for India Patent Application No. 202114002467, filed Jan. 19, 2021, dated Dec. 31, 2021, 6 pgs.

(Continued)

*Primary Examiner* — David M Upchurch
(74) *Attorney, Agent, or Firm* — Taylor English Duma LLP

(57) ABSTRACT

A slider for a slide fastener in which the slider is attached to fastener chains is provided. The slider includes a first member and a second member. The first member includes an upper blade, a lower blade, a guide post connected between the upper blade and the lower blade, and a connecting post protruding from the upper blade. The second member includes a first arm and a second arm separated from each other, is attached to the first member by the first arm and the second arm, and is configured to rotate along an upper-lower direction relative to the first member and around a fulcrum provided on the upper blade or the lower blade. The first member or the second member is provided with a flange. Three or more fit sections are formed between the first member and the second member.

20 Claims, 10 Drawing Sheets

(56) References Cited

U.S. PATENT DOCUMENTS

| | | | | |
|---|---|---|---|---|
| 5,031,286 | A * | 7/1991 | Kedzierski | A44B 19/26 24/429 |
| 5,632,070 | A * | 5/1997 | Wakabayashi | A44B 19/305 24/429 |
| 7,117,567 | B1 * | 10/2006 | Krulik | A44B 19/262 24/429 |
| 8,082,635 | B2 | 12/2011 | Leveau | |
| 8,205,306 | B2 * | 6/2012 | Kovach | A44B 19/262 24/429 |
| 9,545,134 | B1 * | 1/2017 | Tan | A44B 19/262 |
| 2003/0079317 | A1 * | 5/2003 | Oda | A44B 19/26 24/429 |
| 2003/0079318 | A1 * | 5/2003 | Oda | A44B 19/26 24/429 |
| 2004/0020017 | A1 * | 2/2004 | Nedbal | A44B 19/262 24/429 |
| 2004/0034974 | A1 * | 2/2004 | Arai | A44B 19/262 24/429 |
| 2005/0102803 | A1 * | 5/2005 | Wen | A44B 19/262 24/415 |
| 2011/0005043 | A1 * | 1/2011 | Kovach | A44B 19/262 24/429 |
| 2015/0157097 | A1 | 6/2015 | Matsushima et al. | |
| 2015/0189954 | A1 | 7/2015 | Yoneoka et al. | |
| 2017/0071294 | A1 * | 3/2017 | Ozawa | A44B 19/262 |
| 2017/0290395 | A1 | 10/2017 | Ogura | |

FOREIGN PATENT DOCUMENTS

| | | |
|---|---|---|
| CN | 104287324 | 1/2015 |
| CN | 107259722 | 10/2017 |
| CN | 207355616 | 5/2018 |
| CN | 214103487 U | 9/2021 |
| DE | 112012006653 B4 | 6/2019 |
| GB | 771473 A | 4/1957 |
| JP | 2582960 | 12/2015 |
| JP | 5828960 | 12/2015 |

OTHER PUBLICATIONS

YKK Corporation; Office Action for Japanese patent application No. 2020-217288, dated Feb. 8, 2022, 6 pgs.

YKK Corporation; Office Action for German patent application No. 10 2021 000 285.7, dated Jul. 15, 2022, 11 pgs.

* cited by examiner

400

500

SLIDER AND SLIDER ASSEMBLING METHOD

CROSS-REFERENCE TO RELATED APPLICATIONS

The disclosure of Chinese Patent Application No. 202010073401.5 filed on Jan. 22, 2020, including specification, drawings and claims is incorporated herein by reference in its entirety.

BACKGROUND

The present invention relates to a slider and a slider assembling method, and particularly relates to a slider and a slider assembling method form a slide fastener by attaching the slider to fastener chains.

A related slide fastener generally includes a pair of fastener chains and a slider. Each of the fastener chains is formed of a strip-shaped fastener tape and a plurality of elements arranged on the fastener tape. The slider is attached to the fastener chains and opens or closes the elements by sliding. Further, a pull can be provided on the slider as needed. Therefore, a user can interlock the pull and the slider to slide the slider on the fastener chains by pulling the pull. Here, the slider generally includes an upper blade, a lower blade, a guide post connected between the upper blade and the lower blade, and a connecting post protruding from the upper blade. After the slider is assembled to the fastener chains, the fastener chains can be guided by the guide post to open or close the elements through a passage between the upper blade and the lower blade during a sliding process of the slider.

In a related method, generally, a slider is first attached to fastener chains to form a slide fastener, and then the entire slide fastener is sewed on fabric. Therefore, after fastener chains of a non-sewn slide fastener having an adhesive layer or the like is adhered to fabric, it is difficult to attach a slider to the fastener chains. In addition, after a slide fastener is sewed to fabric, it is difficult to replace an old slider with a new slider on the slide fastener. In contrast, there is a method for manufacturing a slider having two separated members now. A slide fastener can be formed by attaching the two separated members of the slider to fastener chains from both an upper side and a lower side of the fastener chains sewed or adhered to fabric. In the method, a fulcrum (such as a pivot shaft) is provided around a guide post and the two separated members can rotate relative to each other. However, in such a slider, the two members of the slider are only fitted at one point (that is, the pivot shaft), and a fitting portion is located near the guide post for opening or closing elements of the slider. Therefore, after a slide fastener is formed by attaching a slider to fastener chains, sliding resistance of the slider is relatively large (that is, it is difficult to slide the slider relative to the fastener chains), and the two members of the slider are likely to be separated.

[Patent Literature 1] U.S. Pat. No. 8,082,635

[Patent Literature 2] Japanese Patent No. 5828960

[Patent Literature 3] Chinese Patent Publication No. 104287324A

SUMMARY

The present invention provides a slider and a slider assembling method that can be applied to a non-sewn slide fastener having an adhesive layer or the like, can be applied to replacement of a slider of a slide fastener after being sewed, and has a relatively stable structure that is less likely to be separated and is not affected by sliding resistance.

According to an embodiment of the present invention, there is provided a slider for a slide fastener in which the slider is attached to fastener chains, the slider including:

a first member that includes an upper blade, a lower blade, a guide post connected between the upper blade and the lower blade, and a connecting post protruding from the upper blade; and a second member that includes a first arm and a second arm separated from each other, is attached to the first member by the first arm and the second arm, and is configured to rotate along an upper-lower direction relative to the first member and around a fulcrum provided on the upper blade or the lower blade, wherein the first member or the second member is provided with a flange, and three or more fit sections are formed between the first member and the second member.

In the slider according to an embodiment of the present invention, the three or more fit sections are distributed in a length direction and a width direction of the slider.

In the slider according to an embodiment of the present invention, the slider may be configured such that the first arm is provided with a first fitting portion, the second arm is provided with a second fitting portion, the first member is provided with a first counter-fitting portion and a second counter-fitting portion respectively corresponding to the fulcrum at left and right sides of the first member, and the first fitting portion and the second fitting portion are fitted to the first counter-fitting portion and the second counter-fitting portion such that the first arm and the second arm of the second member are coupled to the left and right sides of the first member, to form a first fit section and a second fit section among the three or more fit sections.

In the slider according to an embodiment of the present invention, the first fitting portion and the second fitting portion are fitting convex columns, and the first counter-fitting portion and the second counter-fitting portion are fitting concave holes.

In the slider according to an embodiment of the present invention, the first fitting portion and the second fitting portion are fitting concave holes, and the first counter-fitting portion and the second counter-fitting portion are fitting convex columns.

In the slider according to an embodiment of the present invention, the first fitting portion and the second fitting portion are fitting notches, and the first counter-fitting portion and the second counter-fitting portion are fitting convex columns.

In the slider according to an embodiment of the present invention, the slider may be configured such that a third fitting portion is provided at an end portion of the second member opposite to the fulcrum in a length direction of the slider, and a third counter-fitting portion is provided at an end portion of the first member opposite to the fulcrum in the length direction, and the third fitting portion is fitted to the third counter-fitting portion such that the end portion of the second member is coupled to the end portion of the first member, to form a third fit section among the three or more fit sections.

In the slider according to an embodiment of the present invention, the third fitting portion is a fitting concave hole, and the third counter-fitting portion is a fitting convex column.

In the slider according to an embodiment of the present invention, the third fitting portion is a fitting notch, and the third counter-fitting portion is a fitting latch.

In the slider according to an embodiment of the present invention, notches are provided at two opposite sides of the third fitting portion.

In the slider according to an embodiment of the present invention, the fulcrum is provided on the upper blade, and the second member is attached above the upper blade of the first member.

In the slider according to an embodiment of the present invention, the fulcrum is provided on the lower blade, and the second member is attached below the lower blade of the first member.

According to an embodiment of the present invention, there is provided a slider assembling method, for assembling a slide fastener by attaching the slider according to any one of claims 1 to 12 to the fastener chains, the slider assembling method including: attaching the second member to the first member to form the first fit section and the second fit section among the three or more fit sections;

attaching the first member to the fastener chains such that the fastener chains pass through a space between the upper blade and the lower blade; and rotating the second member along an upper-lower direction relative to the first member and around the fulcrum until the second member is fitted to the first member, to form the third fit section among the three or more fit sections.

DETAILED DESCRIPTION OF EXEMPLIFIED EMBODIMENTS

Figure 1:
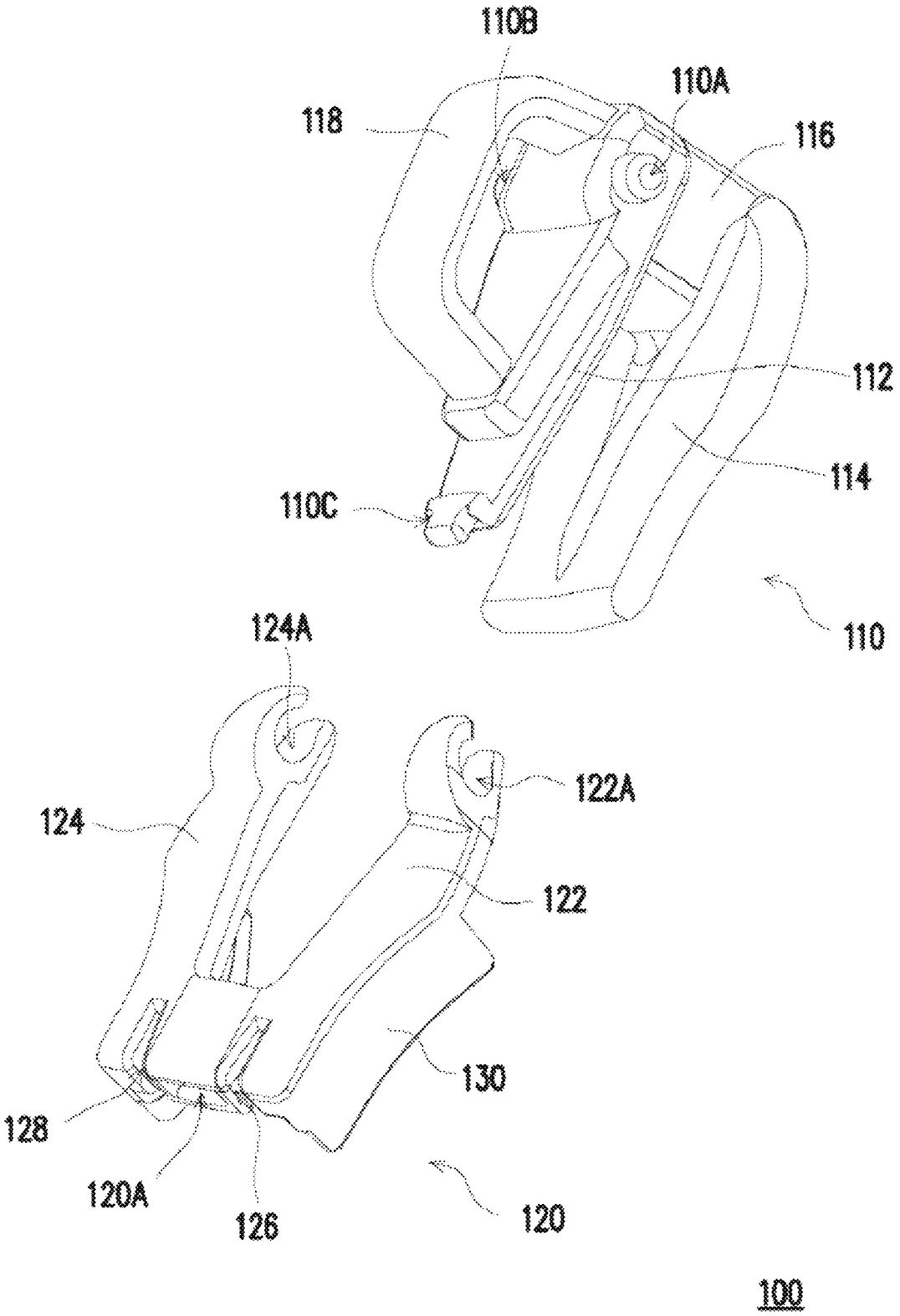
FIG. 1 is an exploded view showing a slider according to a first embodiment of the present invention.
Figure 2:
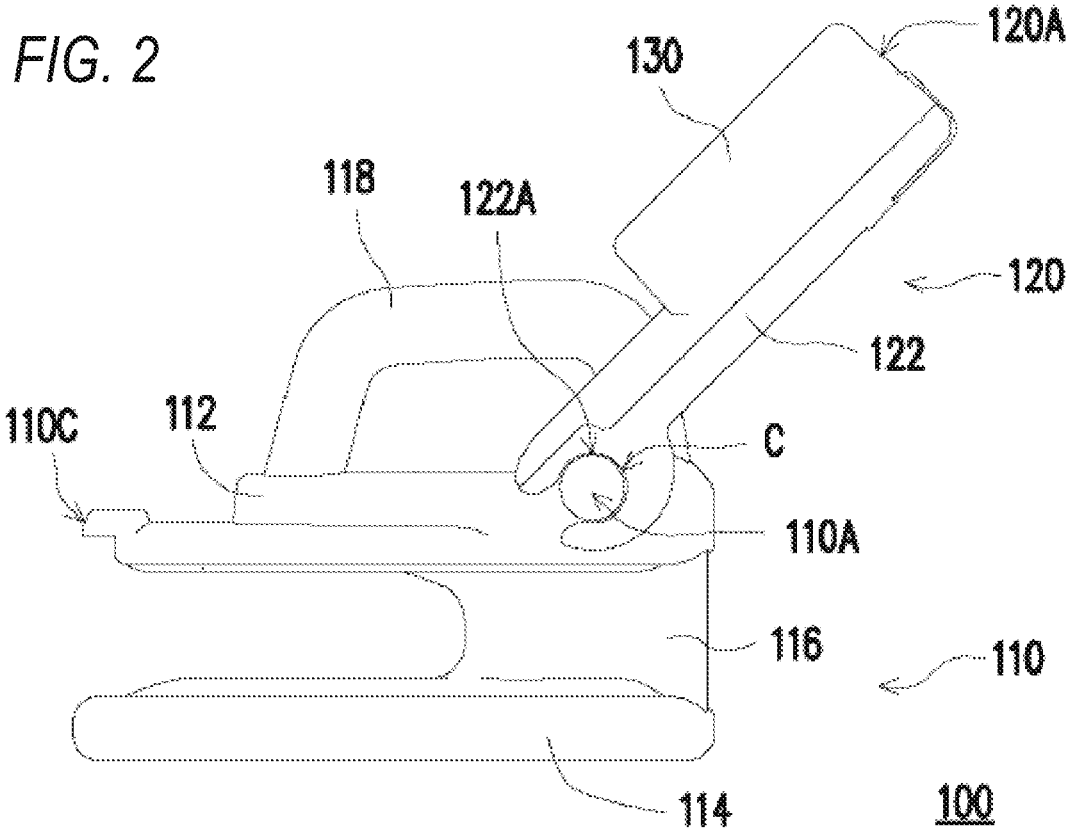
FIGS. 2 and 3 are side views showing different states of the slider in FIG. 1 during an assembly process.
Figure 3:
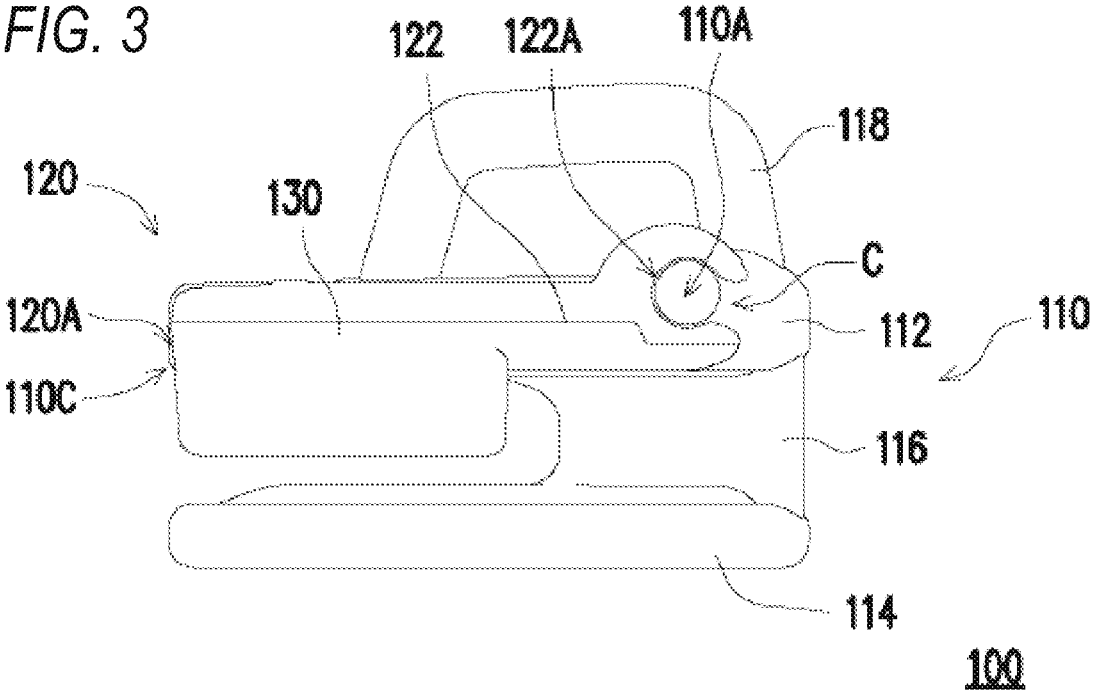
Figure 4:
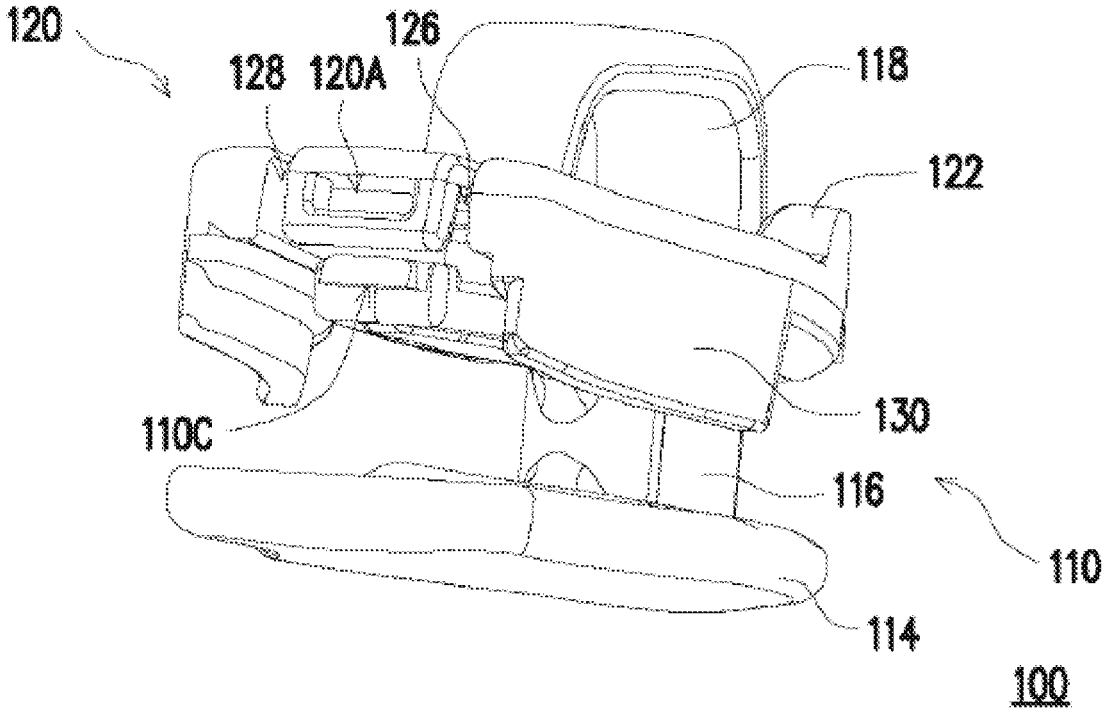
FIGS. 4 and 5 are perspective views showing different states of the slider in FIG. 1 during the assembly process.
Figure 5:
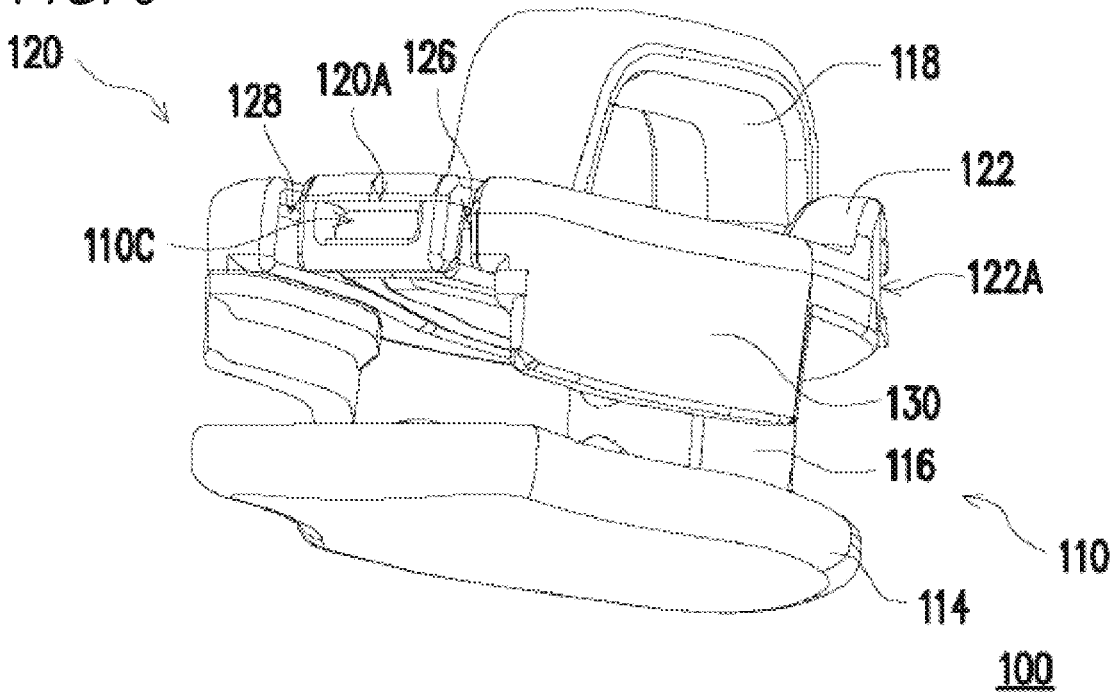

FIG. 1 is an exploded view showing a slider 100 according to a first embodiment of the present invention. FIGS. 2 and 3 are side views showing different states of the slider 100 in FIG. 1 during an assembly process. FIGS. 4 and 5 are perspective views showing different states of the slider 100 in FIG. 1 during the assembly process. In the present embodiment, the slider 100 is attached to fastener chains (not shown) to form a slide fastener. Hereinafter, a specific structure of the slider 100 according to the present embodiment will be described with reference to FIGS. 1 to 5.

As shown in FIG. 1, the slider 100 includes a first member 110 and a second member 120 in the present embodiment. The first member 110 includes an upper blade 112, a lower blade 114, a guide post 116 connected between the upper blade 112 and the lower blade 114, and a connecting post 118 protruding from the upper blade 112. The second member 120 is attached above the upper blade 112 of the first member 110, and is configured to rotate along an upper-lower direction of the slider 100 relative to the first member 110 and around a fulcrum C provided on the upper blade 112. That is, after the second member 120 is attached to the first member 110, the second member 120 can rotate along the upper-lower direction relative to the first member 110 and around the fulcrum C provided on the upper blade 112 as shown in FIGS. 2 and 3. When the second member 120 is attached to the first member 110 to form the slider 100, three or more fit sections are provided between the first member 110 and the second member 120, and the slider 100 has a relatively stable structure that is less likely to be separated and is not affected by sliding resistance.

Specifically, the second member 120 includes a first arm 122 and a second arm 124 that are separated from each other, and is attached to the first member 110 by the first arm 122 and the second arm 124 in the present embodiment. A first fitting portion 122A is provided in the first arm 122, and a second fitting portion 124A is provided in the second arm 124. On the other hand, a first counter-fitting portion 110A and a second counter-fitting portion 110B respectively corresponding to the fulcrum C are provided at left and right sides of the first member 110. In this manner, when the first fitting portion 122A and the second fitting portion 124A are fitted to the first counter-fitting portion 110A and the second counter-fitting portion 110B, the first arm 122 and the second arm 124 of the second member 120 are coupled to the left and right sides of the first member 110, and a first fit section and a second fit section among the three or more fit sections are formed as shown in FIGS. 2 and 3.

In the present embodiment, a third fitting portion 120A is provided at an end portion of the second member 120 opposite to the fulcrum C in a length direction (a left-right direction in FIGS. 2 and 3) of the slider 100, and a third counter-fitting portion 110C is provided at an end portion of the first member 110 opposite to the fulcrum C in the length direction of the slider 100. In this manner, when the third fitting portion 120A is fitted to the third counter-fitting portion 110C, the end portion of the second member 120 is coupled to the end portion of the first member 110, and a third fit section among the three or more fit sections is formed as shown in FIG. 5.

In the present embodiment, flanges 130 are respectively provided at two opposite sides of the second member 120. The flanges 130 are formed to extend from the two opposite sides of the second member 120. In this manner, after the second member 120 is attached to the first member 110, the flanges 130 provided on the second member 120 are positioned between the first member 110 and the second member 120, and the flanges 130 are positioned between the upper blade 112 and the lower blade 114 of the first member 110. Accordingly, the upper blade 112 and the lower blade 114 of the first member 110, the second member 120, and the flanges 130 form a passage for allowing fastener chains (not shown) to pass through.

An assembling method of the slider 100 includes the following steps in the present embodiment.

First, the second member 120 is attached to the first member 110, that is, the first fitting portion 122A of the first arm 122 of the second member 120 and the second fitting portion 124A of the second arm 124 of the second member 120 are fitted to the first counter-fitting portion 110A and the second counter-fitting portion 110B to couple the first arm 122 and the second arm 124 of the second member 120 to the left and right sides of the first member 110, so that the first fit section and the second fit section among the three or more fit sections are formed. The first member 110 and the second member 120 can be formed by injection molding a metal such as zinc, and a surface treatment can be performed after the first member 110 and the second member 120 are assembled to each other, but the present invention is not limited thereto.

Next, the first member 110 is attached to fastener chains (not shown), and the fastener chains pass through a space between the upper blade 112 and the lower blade 114. More specifically, in the slider 100, a size of the upper blade 112 of the first member 110 is made smaller than a size of the lower blade 114 so as to correspond to the second member 120. In this manner, the upper blade 112 having a relatively small size of the first member 110 moves through the fastener chains, and the fastener chains easily pass through the space between the upper blade 112 and the lower blade 114. Since the flanges 130 are provided on the second member 120, it is preferable to dispose a surface on which elements of the fastener chains are sewn toward the second member 120, but the present invention is not limited thereto.

Finally, the second member 120 is rotated along the upper-lower direction relative to the first member 110 and around the fulcrum C, and the third fitting portion 120A is fitted to the third counter-fitting portion 110C so as to couple an end portion of the second member 120 to an end portion of the first member 110, so that the third fit section among the three or more fit sections is formed. Further, since the flanges 130 provided on the second member 120 limit the elements of the fastener chains (not shown) passing through the space between the upper blade 112 and the lower blade 114, the slider 100 can slide on the fastener chains, can open or close the elements, and does not come off from the fastener chains.

The above contents show one of assembling methods of the slider 100 according to the present embodiment. Examples of other assembling methods include a method in which first the first member 110 is attached to the fastener chains (not shown), then the fastener chains pass through the space between the upper blade 112 and the lower blade 114, and thereafter the second member 120 is attached to the first member 110, and three or more fit sections are sequentially formed. As described above, the assembling method of the slider 100 according to the present invention is not limited to the above-described methods, and can be adjusted as needed.

As shown in FIGS. 1 to 3, in the present embodiment, the first fitting portion 122A and the second fitting portion 124A are fitting notches having a substantially C shape, and the first counter-fitting portion 110A and the second counter-fitting portion 110B are fitting convex columns protruding outward from two opposite sides of the upper blade 112 of the first member 110. In this manner, the fitting notches of the second member 120 can be fitted to the fitting convex columns at the left and right sides of the first member 110 at any insertion angle in a range of about 10 degrees (that is, the second member 120 is close to a position directly above the first member 110) to 180 degrees (that is, the second member 120 is positioned at a front end of the first member and is substantially parallel to the first member 110), so as to form the first fit section and the second fit section. Therefore, a fit operation for forming the first fit section and the second fit section can be more easily performed by using the fitting notches having a substantially C shape as the first fitting portion 122A and the second fitting portion 124A. The present invention is not limited thereto, and structures according to other embodiments will be described later.

As shown in FIGS. 1, 4, and 5, in the present embodiment, the third fitting portion 120A is a fitting concave hole provided in a side wall extending to a side surface of a rear end of the second member 120, and the third counter-fitting portion 110C is a fitting convex column extending from an end portion opposite to the fulcrum C of the first member 110 to a rear end of the first member 110. In this manner, the second member 120 is rotated along the upper-lower direction relative to the first member 110 and around the fulcrum C until the second member 120 is positioned above the first member 110. Then, the second member 120 is further pushed down so as to bring the side wall extending to the side surface of the rear end of the second member 120 into contact with the fitting convex column extending to the rear end of the first member 110 and fit the fitting convex column to the fitting concave hole provided in the side wall, thereby forming the third fit section. It is preferable to provide notches 126 and 128 at two opposite sides of the third fitting portion 120A. In this manner, an end portion of the second member 120 where the third fitting portion 120A is formed can have flexibility and a fit operation for forming the third fit section can be more easily performed. The present invention is not limited thereto, and structures according to other embodiments will be described later.

In the slider 100 according to the present embodiment, the first member 110 and the second member 120 form the first fit section (including the first fitting portion 122A and the first counter-fitting portion 110A) and the second fit section (including the second fitting portion 124A and the second counter-fitting portion 110B) in a width direction of the slider 100, and form the third fit section (including the third fitting portion 120A and the third counter-fitting portion 110C) in the length direction of the slider 100. That is, the three or more fit sections of the slider 100 are distributed in the length direction and the width direction of the slider 100.

In this manner, when replacing the slider 100, it is not necessary to completely separate the first member 110 and the second member 120, and the slider 100 can be attached to fastener chains (not shown) by rotating the second member 120 relative to the first member 110. Further, since the second member 120 has a bifurcated structure including the first arm 122 and the second arm 124, the second member 120 does not collide with the connecting post 118 of the first member 110 even when the second member 120 is rotated upward. That is, when the second member 120 is rotated upward, since the connecting post 118 of the first member 110 is positioned in a space between the first arm 122 and the second arm 124, the second member 120 does not collide with the connecting post 118 of the first member 110. Since the first member 110 and the second member 120 are fitted in the length direction and the width direction of the slider 100, the first member 110 and the second member 120 are less likely to be separated due to sliding resistance caused by sliding the slider 100 on the fastener chains. Further, since the fulcrum C is provided on the upper blade 112 instead of being provided near the guide post 116, an influence of the sliding resistance generated when the slider 100 slides on the fastener chains can be reduced, and the slider 100 can stably slide on the fastener chains. The present invention is not limited thereto, and can be adjusted as needed.

Although a specific structure according to the first embodiment of the present invention is described above, the present invention is not limited thereto. For example, although three fit sections are described in the first embodiment, in other embodiments (not shown), more fit sections can be provided and the first member 110 and the second member 120 can be coupled more stably. The number of the fit sections according to the present invention is not limited to three, and specific positions of the three or more fit sections are not limited. The specific positions of the three or more fit sections can be adjusted as needed. Another specific structure of a slider according to a subsequent embodiment will be below, and the slider according to the subsequent embodiment can be assembled using the assembling method described above.

Figure 6:
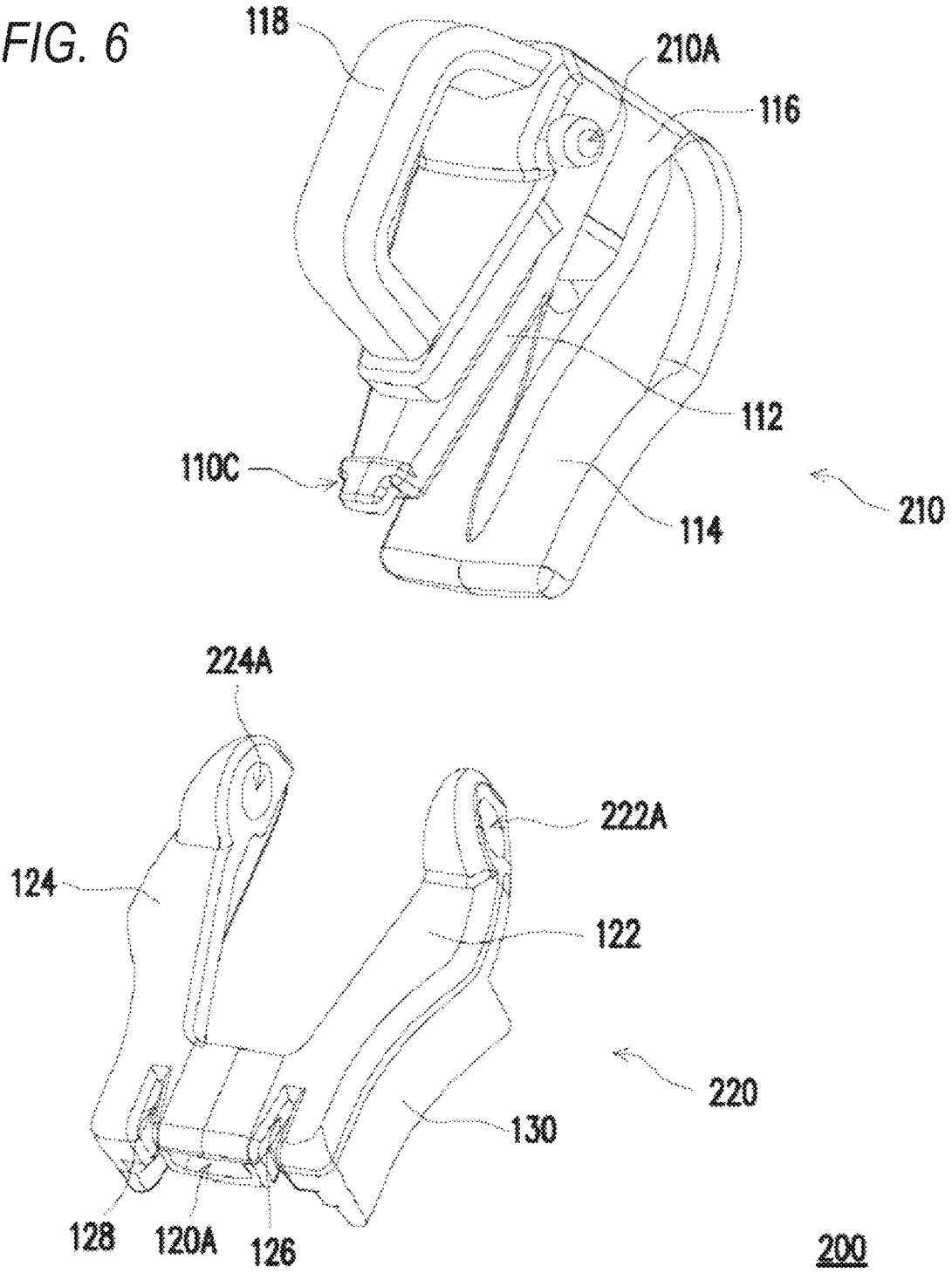
FIG. 6 is an exploded view showing a slider according to a second embodiment of the present invention.

FIG. 6 is an exploded view showing a slider 200 according to a second embodiment of the present invention. As shown in FIG. 6, the slider 200 according to the present embodiment has a structure similar to the structure of the slider 100. Differences will be mainly described below. When a first fitting portion 222A and a second fitting portion 224A are fitted to a first counter-fitting portion 210A and a second counter-fitting portion (not shown), a second member 220 of the slider 200 is coupled to left and right sides of a first member 210, and a first fit section and a second fit section among three or more fit sections are formed. The first fitting portion 222A and the second fitting portion 224A are fitting concave holes. The first counter-fitting portion 210A and the second counter-fitting portion are fitting convex columns.

In this manner, compared with a case where the first member 110 and the second member 120 can be assembled at any insertion angle in a range of about 10 degrees to 180 degrees in the slider 100 shown in FIGS. 1 to 5, in the slider 200 shown in FIG. 6, the first arm 122 and the second arm 124 of the second member 220 are attached to the left and right sides of the first member 210 in a manner of being riveted to the left and right sides. That is, the first arm 122 and the second arm 124 of the second member 220 are opened outward in a process of attaching the second member 220 to the first member 210, and the fitting concave holes serving as the first fitting portion 222A and the second fitting portion 224A can be fitted to the fitting convex columns serving as the first counter-fitting portion 210A and the second counter-fitting portion from the left and right sides. The present invention is not limited thereto, and can be adjusted as needed.

Figure 7:
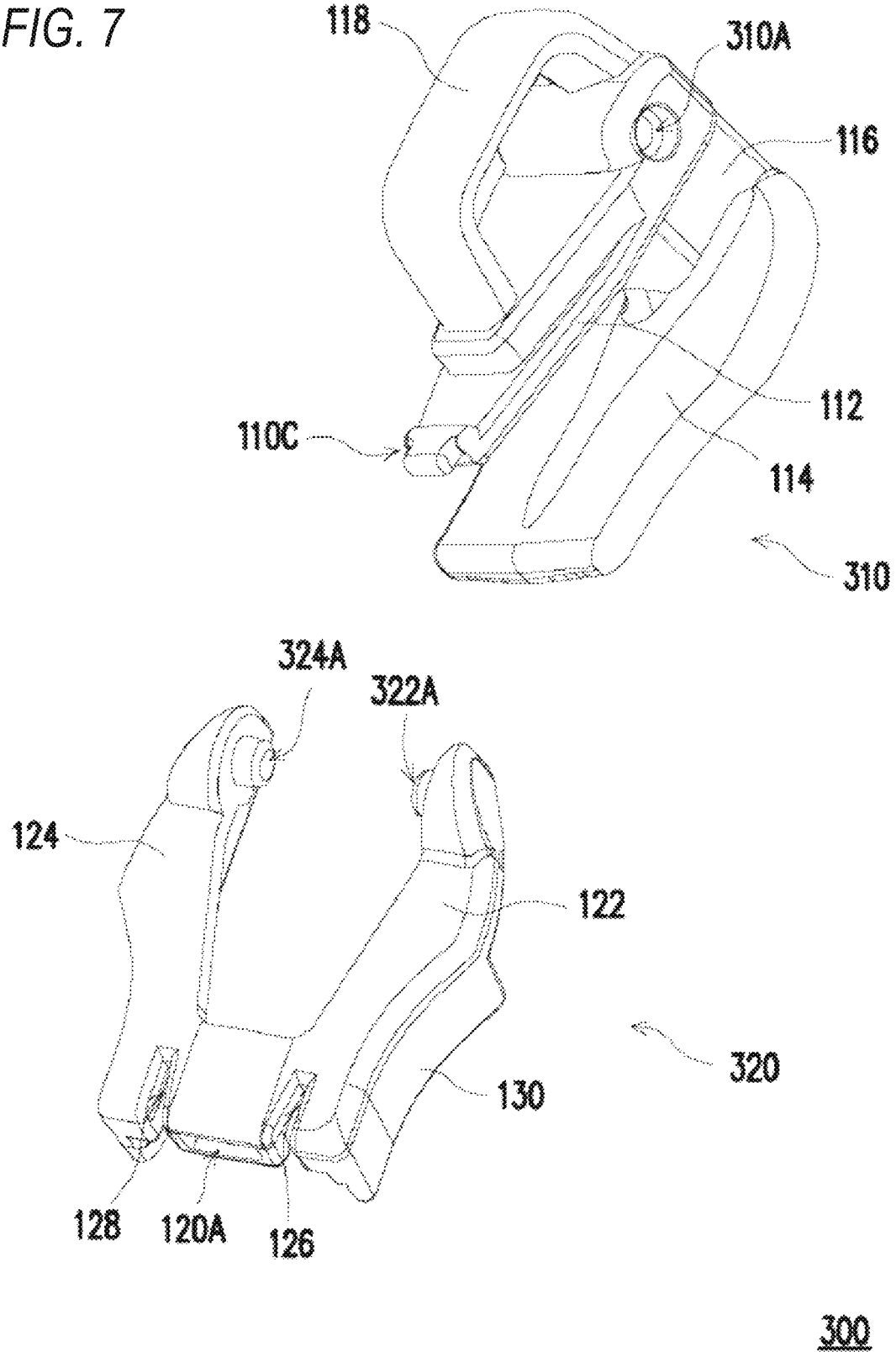
FIG. 7 is an exploded view showing a slider according to a third embodiment of the present invention.

FIG. 7 is an exploded view showing a slider 300 according to a third embodiment of the present invention. As shown in FIG. 7, the slider 300 according to the present embodiment has a structure similar to the structures of the sliders 100 and 200. Differences will be mainly described below. When a first fitting portion 322A and a second fitting portion 324A are fitted to a first counter-fitting portion 310A and a second counter-fitting portion (not shown), a second member 320 of the slider 300 is coupled to left and right sides of a first member 310, and a first fit section and a second fit section among three or more fit sections are formed. The first fitting portion 322A and the second fitting portion 324A are fitting convex columns. The first counter-fitting portion 310A and the second counter-fitting portion are fitting concave holes.

In this manner, compared with a case where the first member 110 and the second member 120 can be assembled at any insertion angle in a range of about 10 degrees to 180 degrees in the slider 100 shown in FIGS. 1 to 5, in the slider 300 shown in FIG. 7, the first arm 122 and the second arm 124 of the second member 320 are attached to the left and right sides of the first member 310 in a manner of being riveted to the left and right sides. That is, the first arm 122 and the second arm 124 of the second member 320 are opened outward in a process of attaching the second member 320 to the first member 310, and the fitting convex columns serving as the first fitting portion 322A and the second fitting portion 324A can be fitted to the fitting concave holes serving as the first counter-fitting portion 310A and the second counter-fitting portion from the left and right sides. The present invention is not limited thereto, and can be adjusted as needed.

Figure 8:
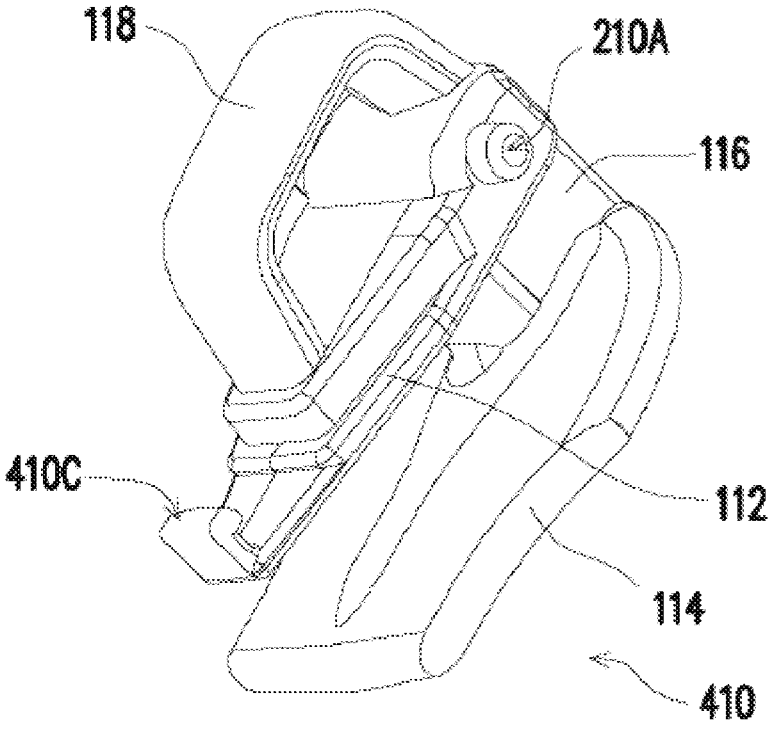
FIG. 8 is an exploded view showing a slider according to a fourth embodiment of the present invention.
Figure 8:
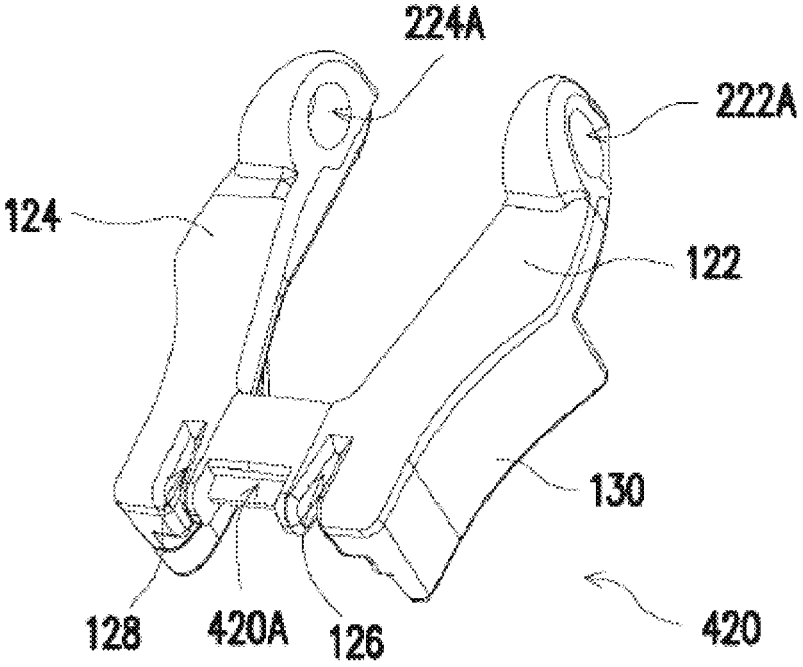
Figure 9:
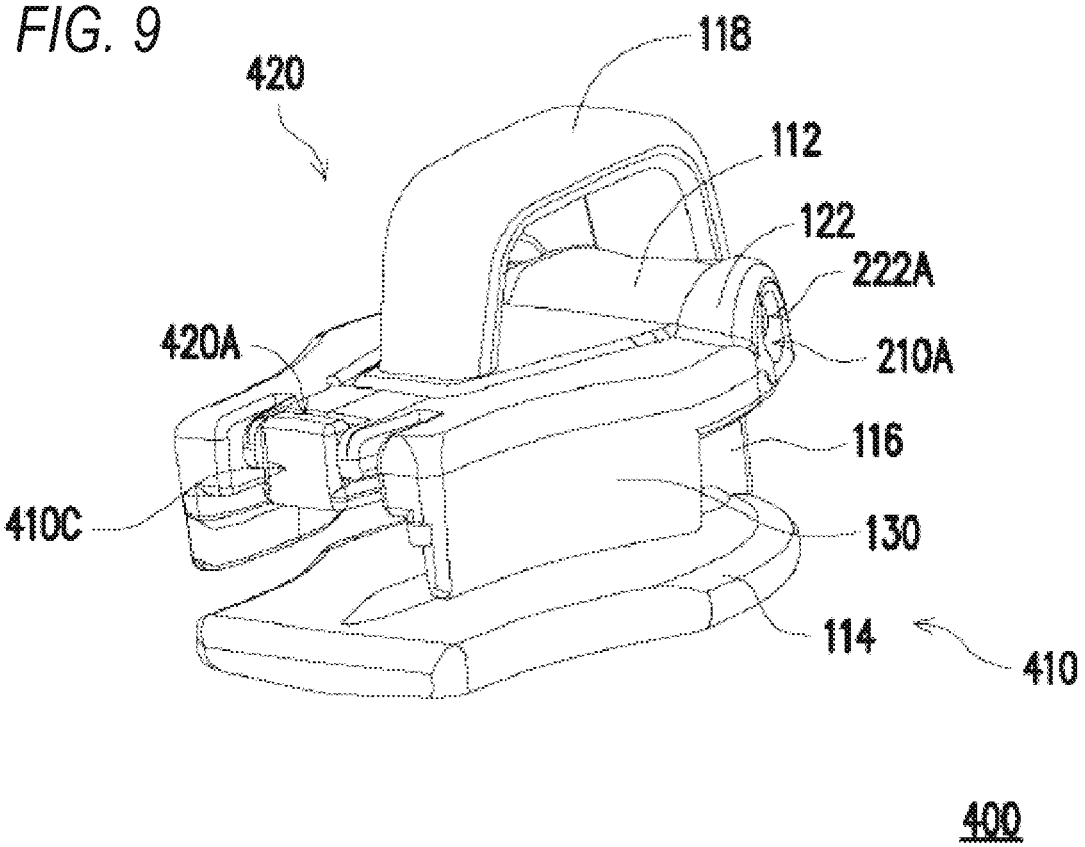
FIG. 9 is a perspective view showing the slider in FIG. 8.

FIG. 8 is an exploded view showing a slider 400 according to a fourth embodiment of the present invention. FIG. 9 is a perspective view showing the slider 400 in FIG. 8. As shown in FIGS. 8 and 9, the slider 400 according to the present embodiment has a structure similar to the structures of the sliders 100, 200, and 300. Differences will be mainly described below. When a third fitting portion 420A is fitted to a third counter-fitting portion 410C, an end portion of a second member 420 of the slider 400 is coupled to an end portion of a first member 410, and a third fit section among the three or more fit sections is formed. The third fitting portion 420A is a fitting notch, and the third counter-fitting portion 410C is a fitting latch.

In this manner, as compared with a case in the slider 100 shown in FIGS. 1 to 5 where the fitting concave hole provided in the side wall of the second member 120 fits the fitting convex column provided at the end portion of the first member 110 from an outer side, in the slider 400 shown in FIGS. 8 and 9, the fitting notch provided at an end portion of the second member 420 fits the fitting latch of the first member 410 from an inner side. That is, in the slider 100 according to the first embodiment, the third fitting portion 120A of the second member 120 fixes the third counter-fitting portion 110C of the first member 110 from an outer side, while in the slider 400 according to the fourth embodiment, the third counter-fitting portion 410C of the first member 410A fixes the third fitting portion 420A of the second member 420 from an outer side. The present invention is not limited thereto, and can be adjusted as needed.

Forms of the first fit section and the second fit section according to the present invention are not limited thereto. Specific structures of the first fit section and the second fit section can be adjusted as needed as long as the first fitting portion and the second fitting portion of the second member can be fitted to the first counter-fitting portion and the second counter-fitting portion of the first member. Similarly, a form of the third fit section according to the present invention is not limited thereto. A specific structure of the third fit section can be adjusted as needed as long as the third fitting portion of the second member can be fitted to the third counter-fitting portion of the first member.

Although the slider 400 according to the fourth embodiment shown in FIGS. 8 and 9 adopts a first fit section (including the first fitting portion 222A and the first counter-fitting portion 210A) and a second fit section (including the second fitting portion 224A and the second counter-fitting portion) the same as those of the slider 200 according to the second embodiment shown in FIG. 6, the slider 400 may adopt a first fit section (including the first fitting portion 122A and the first counter-fitting portion 110A) and a second fit section (including the second fitting portion 124A and the second counter-fitting portion 110B) the same as those of the slider 100 according to the first embodiment shown in FIGS. 1 to 5, or the slider 400 may adopt a first fit section (including the first fitting portion 322A and the first counter-fitting portion 310A) and a second fit section (including the second fitting portion 324A and the second counter-fitting portion) the same as those of the slider 300 according to the third embodiment shown in FIG. 7. Although the slider 200 according to the second embodiment shown in FIG. 6 and the slider 300 according to the third embodiment shown in FIG. 7 adopt a third fit section (including the third fitting portion 120A and the third counter-fitting portion 110C) the same as that of the slider 100 according to the first embodiment shown in FIGS. 1 to 5, the sliders 200 and 300 may adopt a third fit section (including the third fitting portion 420A and the third counter-fitting portion 410C) the same as that of the slider 400 according to the fourth embodiment shown in FIGS. 8 and 9.

Figure 10:
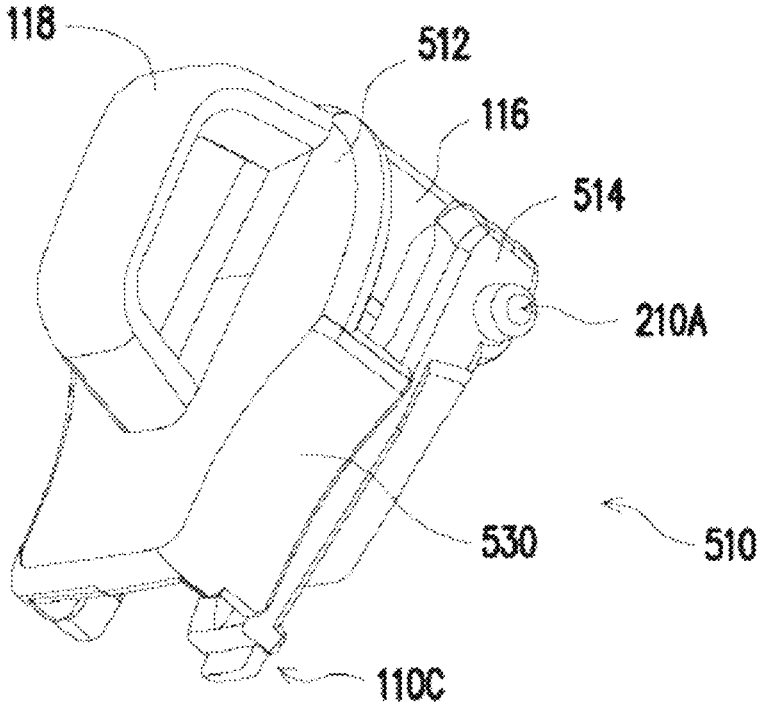
FIG. 10 is an exploded view showing a slider according to a fifth embodiment of the present invention.
Figure 10:
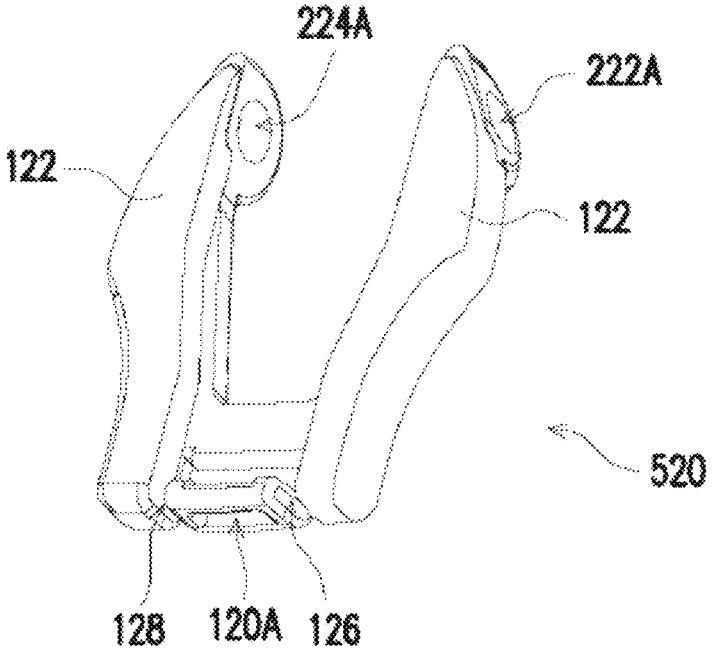
Figure 11:
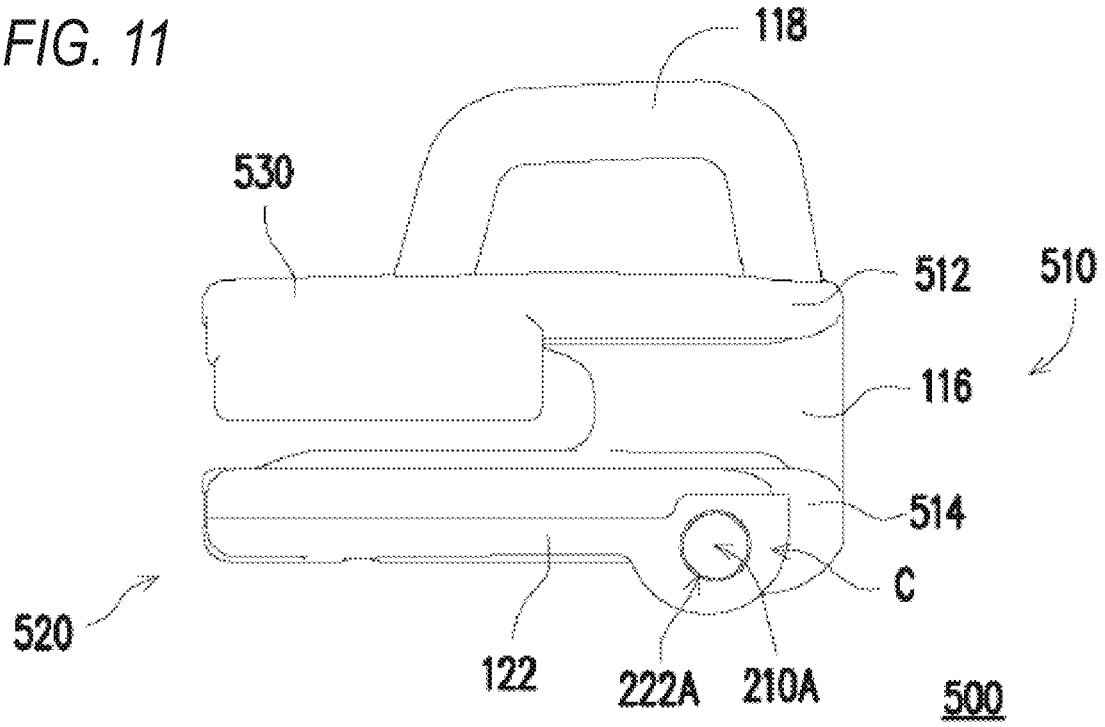
FIG. 11 is a side view showing the slider in FIG. 10.
Figure 12:
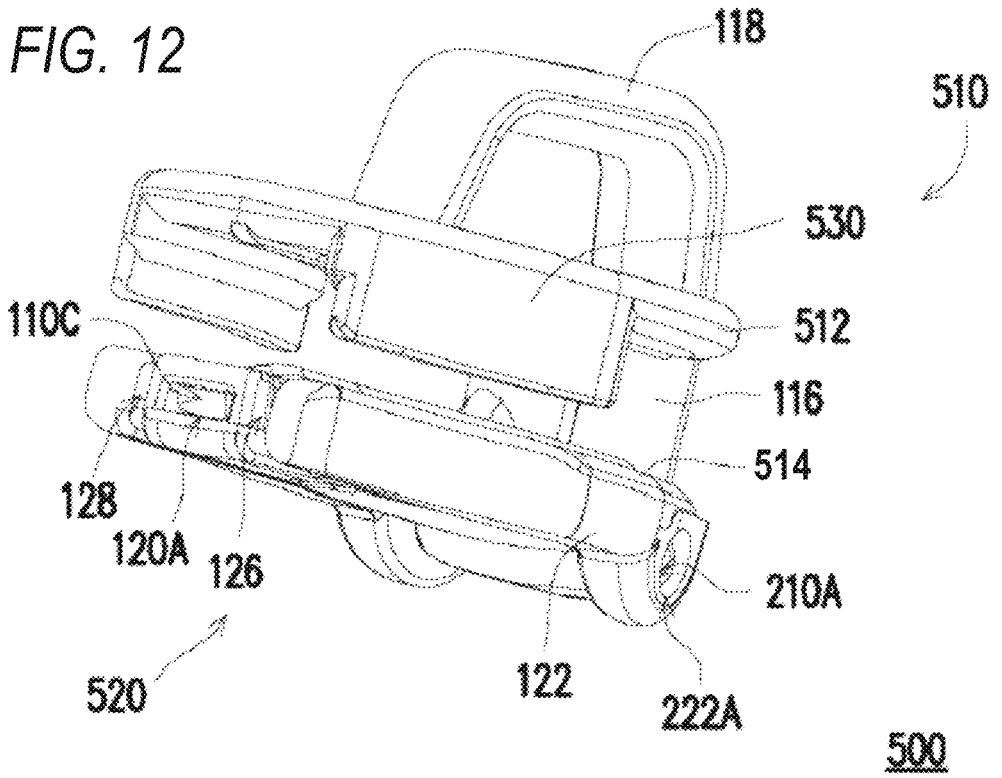
FIG. 12 is a perspective view showing the slider in FIG. 10.

FIG. 10 is an exploded view showing a slider 500 according to a fifth embodiment of the present invention. FIG. 11 is a side view showing the slider 500 in FIG. 10. FIG. 12 is a perspective view showing the slider 500 in FIG. 10. As shown in FIGS. 10 to 12, the slider 500 according to the present embodiment has a structure similar to the structures of the sliders 100, 200, 300, and 400. Differences will be mainly described below. The fulcrum C of the slider 500 is provided on a lower blade 514. A second member 520 is attached below the lower blade 514 of a first member 510, and is configured to rotate along the upper-lower direction relative to the first member 510 and around the fulcrum C provided on the lower blade 514. Flanges 530 are respectively provided at two opposite sides of the first member 510. The flanges 530 are formed to extend from two opposite sides of an upper blade 512 of the first member 510, and the flanges 530 are disposed between the upper blade 512 and the lower blade 514 of the first member 510.

More specifically, in the slider 500 according to the present embodiment, a size of the lower blade 514 of the first member 510 is made smaller than a size of the upper blade 512 so as to correspond to the second member 520. In this manner, the lower blade 514 having a relatively small size of the first member 510 moves through the fastener chains (not shown) and the fastener chains easily pass through a space between the upper blade 512 and the lower blade 514. Since the flanges 530 are provided on the first member 510, it is preferable to dispose a surface on which elements of the fastener chains are sewn toward the first member 510, but the present invention is not limited thereto. In this manner, after the second member 520 is attached to the first member 510, the flanges 530 are positioned between the first member 510 and the second member 520. Accordingly, the upper blade 512 and the lower blade 514 of the first member 510, the second member 520, and the flanges 530 form a passage for allowing the fastener chains (not shown) to pass through. The present invention is not limited thereto, and can be adjusted as needed.

According to the present invention, whether the second member is provided on an upper side or a lower side of the first member is not limited. A position of the second member can be adjusted as needed as long as the fulcrum between the second member and the first member is provided on the upper blade or the lower blade instead of being provided near the guide post. Similarly, according to the present invention, whether the flanges are provided on the first member or the second member is not limited. Positions of the flanges can be adjusted as needed as long as the upper blade and the lower blade of the first member, the second member, and the flanges can form a passage for allowing the fastener chains (not shown) to pass through.

Similarly, although the slider 500 according to the fifth embodiment shown in FIGS. 10 to 12 adopts a first fit section (including the first fitting portion 222A and the first counter-fitting portion 210A) and a second fit section (including the second fitting portion 224A and the second counter-fitting portion) the same as those of the slider 200 according to the second embodiment shown in FIG. 6, the slider 500 may adopt a first fit section (including the first fitting portion 122A and the first counter-fitting portion 110A) and a second fit section (including the second fitting portion 124A and the second counter-fitting portion 110B) the same as those of the slider 100 according to the first embodiment shown in FIGS. 1 to 5, or the slider 500 may adopt a first fit section (including the first fitting portion 322A and the first counter-fitting portion 310A) and a second fit section (including the second fitting portion 324A and the second counter-fitting portion) the same as those of the slider 300 according to the third embodiment shown in FIG. 7. Similarly, although the slider 500 according to the fifth embodiment shown in FIGS. 10 to 12 adopts a third fit section (including the third fitting portion 120A and the third counter-fitting portion 110C) the same as that of the slider 100 according to the first embodiment shown in FIGS. 1 to 5, the slider 500 may adopt a third fit section (including the third fitting portion 420A and the third counter-fitting portion 410C) the same as that of the slider 400 according to the fourth embodiment shown in FIGS. 8 and 9.

As shown in the first embodiment, the first member 110 includes the connecting post 118 protruding from the upper blade 112 as shown in FIGS. 2 and 3. The connecting post 118 can be used in connection to a pull (not shown). That is, the pull (not shown) can be attached to the slider 100 via the connecting post 118. Here, a closed connection ring is adopted to serve as the connecting post 118 in the first to fifth embodiments. A structure of the connecting post according to the present invention is not limited thereto, and the structure of the connecting post can be adjusted corresponding to different types of pulls.

Figure 13:
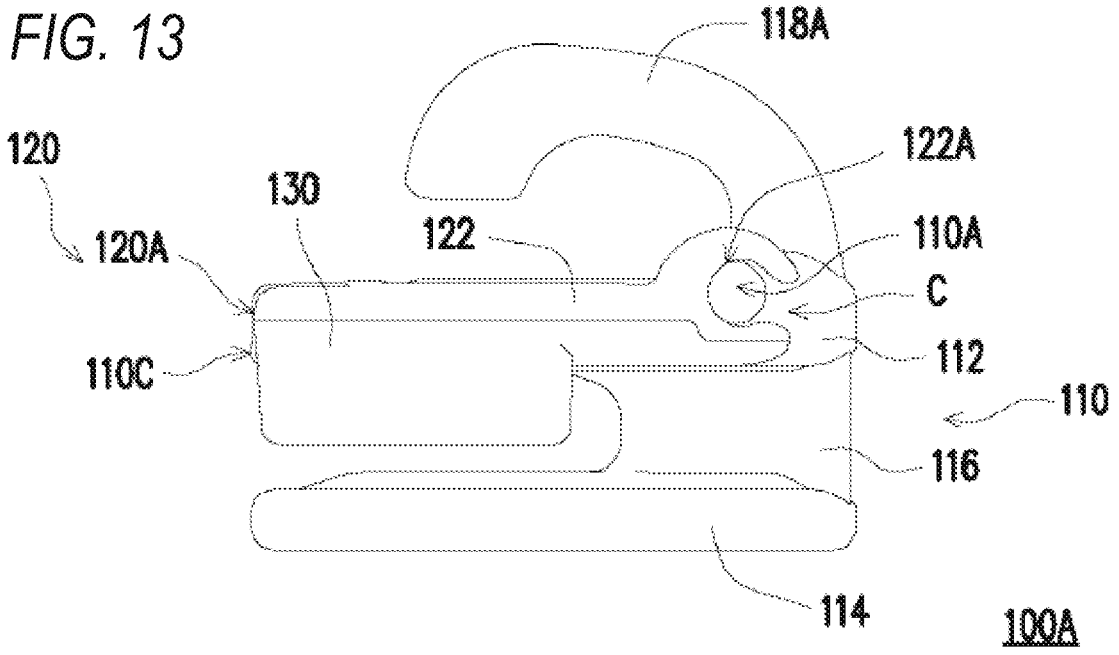
FIGS. 13 and 14 are side views showing sliders according to modifications of the present invention.
Figure 14:
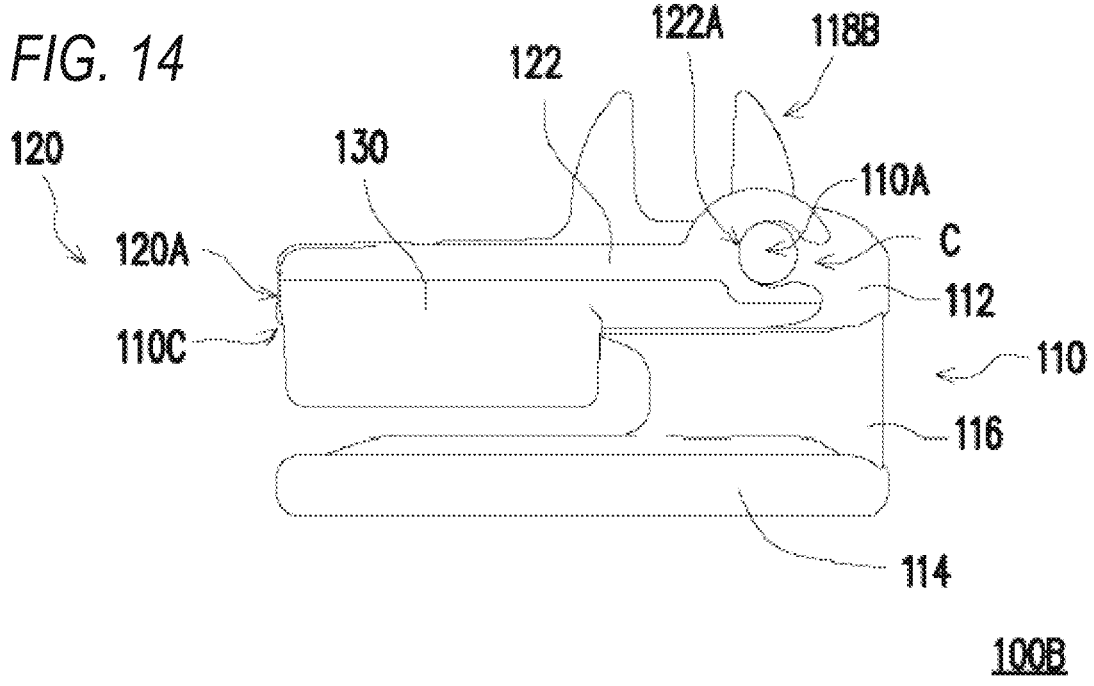

FIGS. 13 and 14 are side views showing sliders 100A and 100B according to modifications of the present invention. As shown in FIG. 13, the slider 100A according to a modification in FIG. 13 has a structure similar to the structure of the slider 100. Differences will be mainly described below. The slider 100A adopts a connection ring whose one end portion is opened rearward as a connecting post 118A. As shown in FIG. 14, the slider 100B according to a modification in FIG. 14 has a structure similar to the structures of the sliders 100 and 100A. Differences will be mainly described below. The slider 100B adopts a connection notch whose one end portion is opened upward as a connecting post 118B. A structure of the connecting post according to the present invention is not limited thereto, and can be adjusted as needed. That is, instead of the connecting post 118, the connecting post 118A shown in FIG. 13 or the connecting post 118B shown in FIG. 14 can be used in the first to fifth embodiments.

The embodiments and the modifications described above are only examples of the slider and the slider assembling method according to the present invention, and a specific structure and an assembling method of the slider according to the present invention can be adjusted as needed, and are not limited to the contents described above. Portions denoted by the same reference numeral in the first to fifth embodiments and the modifications have the same structure, and repeated descriptions are omitted in the embodiments for the convenience of description. Different structures may be adopted and replacement or adjustment may be performed in other embodiments (not shown). The present invention is not limited to the above-described embodiments and modifications.

As described above, the present invention provides a slider and a slider assembling method. The slider includes a first member and a second member. The first member includes an upper blade, a lower blade, a guide post connected between the upper blade and the lower blade, and a connecting post protruding from the upper blade. The second member includes a first arm and a second arm that are separated from each other, and is attached to the first member by the first arm and the second arm. The second member is configured to rotate along an upper-lower direction relative to the first member and around a fulcrum provided on the upper blade or the lower blade of the first member. Three or more fit sections are provided between the first member and the second member. In this manner, when a non-sewn slide fastener having an adhesive layer or the like is adopted, the slider can be attached to fastener chains after fastener chains are adhered to fabric. Alternatively, an old slider can be removed and replaced with the slider after a slide fastener is sewn on fabric. In the slider assembling method, the separated first member and second member are attached to fastener chains, and three or more fit sections are formed. It is not necessary to completely separate the first member and the second member when replacing the slider. Since the second member has a bifurcated structure including the first arm and the second arm, the second member does not collide with the connecting post of the first member even when the second member is rotated upward. Therefore, the slider and the slider assembling method according to the present invention can be applied to a non-sewn slide fastener having an adhesive layer or the like, can be applied to replacement of a slider of a slide fastener after being sewed, and has a relatively stable structure that is less likely to be separated and is not affected by sliding resistance.

It should be noted the embodiments described above are only for the purpose of describing the technical idea of the present invention, and are not intended to limit the present invention. Although the present invention has been described in detail with reference to the embodiments described above, it is obvious to those skilled in the art that the technical idea described in the embodiments described above can be modified or a part or all of technical features can be replaced with another one, and the modifications and replacements are not intended to exclude the essence of corresponding technical idea from the scope of the technical idea of the embodiments of the present invention.

What is claimed is:

1. A slider for a slide fastener in which the slider is attached to fastener chains, the slider comprising:

a first member that includes an upper blade, a lower blade, a guide post connected between the upper blade and the lower blade, and a connecting post protruding from the upper blade; and a second member that includes a first arm and a second arm separated from each other, is attached to the first member by the first arm and the second arm, and is configured to rotate along an upper-lower direction relative to the first member and around a fulcrum defined by the upper blade or the lower blade, wherein:

the second member defines a flange;

the upper blade, the lower blade, and the flange form a passage configured to allow the fastener chains to pass through, a shape of the passage not dependent on a position of a pull of the slide fastener when the pull is attached to the connecting post; and three or more fit sections are formed between the first member and the second member.

2. The slider according to claim 1, wherein the three or more fit sections are distributed in a length direction and a width direction of the slider.

3. The slider according to claim 1, wherein the first arm defines a first fitting portion, the second arm defines a second fitting portion, the first member defines a first counter-fitting portion and a second counter-fitting portion respectively corresponding to the fulcrum at left and right sides of the first member, and the first fitting portion and the second fitting portion are fitted to the first counter-fitting portion and the second counter-fitting portion such that the first arm and the second arm of the second member are coupled to the left and right sides of the first member, to form a first fit section and a second fit section among the three or more fit sections.

4. The slider according to claim 3, wherein the first fitting portion and the second fitting portion are fitting convex columns, and the first counter-fitting portion and the second counter-fitting portion are fitting concave holes.

5. The slider according to claim 3, wherein the first fitting portion and the second fitting portion are fitting concave holes, and the first counter-fitting portion and the second counter-fitting portion are fitting convex columns.

6. The slider according to claim 3, wherein the first fitting portion and the second fitting portion are fitting notches, and the first counter-fitting portion and the second counter-fitting portion are fitting convex columns.

7. The slider according to claim 3, wherein a third fitting portion is defined in an end portion of the second member opposite to the fulcrum in a length direction of the slider, and a third counter-fitting portion is defined in an end portion of the first member opposite to the fulcrum in the length direction, and the third fitting portion is fitted to the third counter-fitting portion such that the end portion of the second member is coupled to the end portion of the first member, to form a third fit section among the three or more fit sections.

8. The slider according to claim 7, wherein the third fitting portion is a fitting concave hole, and the third counter-fitting portion is a fitting convex column.

9. The slider according to claim 7, wherein the third fitting portion is a fitting notch, and the third counter-fitting portion is a fitting latch.

10. The slider according to claim 7, wherein notches are defined in two opposite sides of the third fitting portion.

11. The slider according to claim 1, wherein the fulcrum is defined by the upper blade, and the second member is attached above the upper blade of the first member.

12. The slider according to claim 1, wherein the fulcrum is defined by the lower blade, and the second member is attached below the lower blade of the first member.

13. A slider assembling method, for assembling a slide fastener by attaching the slider according to claim 1 to the fastener chains, the slider assembling method comprising:

attaching the second member to the first member to form a first fit section and a second fit section among the three or more fit sections;

attaching the first member to the fastener chains such that the fastener chains pass through a space between the upper blade and the lower blade; and rotating the second member along an upper-lower direction relative to the first member and around the fulcrum until the second member is fitted to the first member, to form a third fit section among the three or more fit sections.

14. A slider for a slide fastener in which the slider is attached to fastener chains, the slider comprising:

a first member that includes an upper blade, a lower blade, a guide post connected between the upper blade and the lower blade, and a connecting post protruding from the upper blade; and a second member that includes a first arm and a second arm separated from each other, is attached to the first member by the first arm and the second arm, and is configured to rotate along an upper-lower direction relative to the first member and around a fulcrum defined by the upper blade or the lower blade, wherein:

the first member or the second member defines a flange;

three or more fit sections are formed between the first member and the second member;

the first arm defines a first fitting portion and the second arm defines a second fitting portion;

the first member defines a first counter-fitting portion and a second counter-fitting portion respectively corresponding to the fulcrum at left and right sides of the first member;

the first fitting portion and the second fitting portion are fitted to the first counter-fitting portion and the second counter-fitting portion such that the first arm and the second arm of the second member are coupled to the left and right sides of the first member, to form a first fit section and a second fit section among the three or more fit sections;

a third fitting portion is defined in an end portion of the second member opposite to the fulcrum in a length direction of the slider, and a third counter-fitting portion is defined in an end portion of the first member opposite to the fulcrum in the length direction, and the third fitting portion is fitted to the third counter-fitting portion such that the end portion of the second member is coupled to the end portion of the first member, to form a third fit section among the three or more fit sections.

15. The slider according to claim 14, wherein the third fitting portion is a fitting concave hole, and the third counter-fitting portion is a fitting convex column.

16. The slider according to claim 14, wherein the third fitting portion is a fitting notch, and the third counter-fitting portion is a fitting latch.

17. The slider according to claim 14, wherein notches are defined in two opposite sides of the third fitting portion.

18. A slider for a slide fastener in which the slider is attached to fastener chains, the slider comprising:

a first member that includes an upper blade, a lower blade, a guide post connected between the upper blade and the lower blade, and a connecting post protruding from the upper blade; and a second member that includes a first arm and a second arm separated from each other, is attached to the first member by the first arm and the second arm, and is configured to rotate along an upper-lower direction relative to the first member and around a fulcrum defined by the upper blade or the lower blade, wherein:

the first member or the second member defines a flange;

three or more fit sections are formed between the first member and the second member; and the fulcrum is defined by the lower blade, and the second member is attached below the lower blade of the first member.

19. The slider according to claim 1, wherein the flange defines, at least in part, an outer side of the passage.

20. The slider according to claim 1, wherein the second member defines a pair of flanges extending from two opposite sides of the second member, each of the flanges being configured to prevent the fastener chains from separating from the slider.

* * * * *